US006085370A

United States Patent [19]

Lobascio

[11] Patent Number: 6,085,370

[45] Date of Patent: Jul. 11, 2000

[54] DEVICE FOR CARRYING A MATTRESS

[76] Inventor: Marco P. Lobascio, 2506 Richmar La., Brandon, Fla. 33511

[21] Appl. No.: 09/274,288

[22] Filed: Mar. 22, 1999

[51] Int. Cl.[7] ..... B65D 63/18

[52] U.S. Cl. ..... 5/510; 294/152; 294/149

[58] Field of Search ..... 5/510, 703, 499; 294/152, 149; 16/DIG. 28

[56] References Cited

U.S. PATENT DOCUMENTS

| | | | |
|---|---|---|---|
| 2,723,067 | 11/1955 | Fretz | 294/152 |
| 2,727,253 | 12/1955 | Tomsic | 5/496 |
| 5,249,321 | 10/1993 | Graf | 5/494 |
| 5,800,001 | 9/1998 | Anastasi | 294/152 |
| 5,863,056 | 1/1999 | Hostetter | 5/510 X |
| 5,927,781 | 7/1999 | Lyons, Jr. | 294/152 |

*Primary Examiner*—Terry Lee Melius
*Assistant Examiner*—Robert G. Santos
*Attorney, Agent, or Firm*—Harold D. Shall

[57] ABSTRACT

A cover for a mattress usable when the mattress is moved. The cover covers the periphery and flap portions cover a portion of both sides of the mattress. A plurality of peripherally spaced handle straps are riveted to the peripheral portion and the flap portions of the cover and are graspable to move the mattress. In one embodiment, a loop is formed on the inner end of each strap and an elastic cord passes through the loops and its ends secured together to hold the cover on the mattress. In a second embodiment, the cord passes through a hem formed in the inner end of the flap and there are no loops on the straps.

4 Claims, 2 Drawing Sheets

DEVICE FOR CARRYING A MATTRESS

BACKGROUND OF THE INVENTION

1. Field of the Invention

This invention relates to devices for lif ting and moving mattresses and more particularly to such a device which is easily installed on the mattress, provides numerous handholds around the periphery of the mattress, has a resilient cord arrangement therein to hold the device on the mattress and completely encloses the periphery and the adjoining side portions of the mattress when installed.

2. Description of Prior Art

Many devices to assist movers in lifting and moving mattresses exist in the prior art. They have shortcomings in being difficult to install, have a limited number of grasping positions, do not adequately protect the periphery and adjoining surfaces of the sides of the mattress, do not have a peripherally extending elastic member adjoining the grasping portions, which member holds the lifting device on the mattress when installed, and are not easily installed on the mattress when it is still on the frame. The handles that mattress manufactures sew into the long sides of the mattress are not meant to transport the mattress but, rather, are meant to flip or spin the mattress on the box spring. The prior art devices also do not provide handles placed so that the mattress can be carried longitudinally, vertically, parallel to the ground, or upright, while the carrier of the instant invention provides for such alternatives.

SUMMARY OF THE INVENTION

A carrier comprising a sleeve of heavy cloth like material which completes covers the peripheral sides of the mattress and extends over a portion of both of the top and bottom surfaces of the mattress adjoining the peripheral sides thereof. A plurality of straps are secured in peripherally spaced relationship to the peripheral sides of the carrier and extend inwardly therefrom to lie over a portion of the top and bottom mattress surfaces. The inner end of the straps have a loop therein and an elastic cord such as a bungee cord, extends through all the loops and has its ends secured together and holds the carrier on the mattress. To lift and/or move the mattress any of the straps may be grasped.

DETAILED DESCRIPTION OF THE PREFERRED EMBODIMENT

Figure 1:
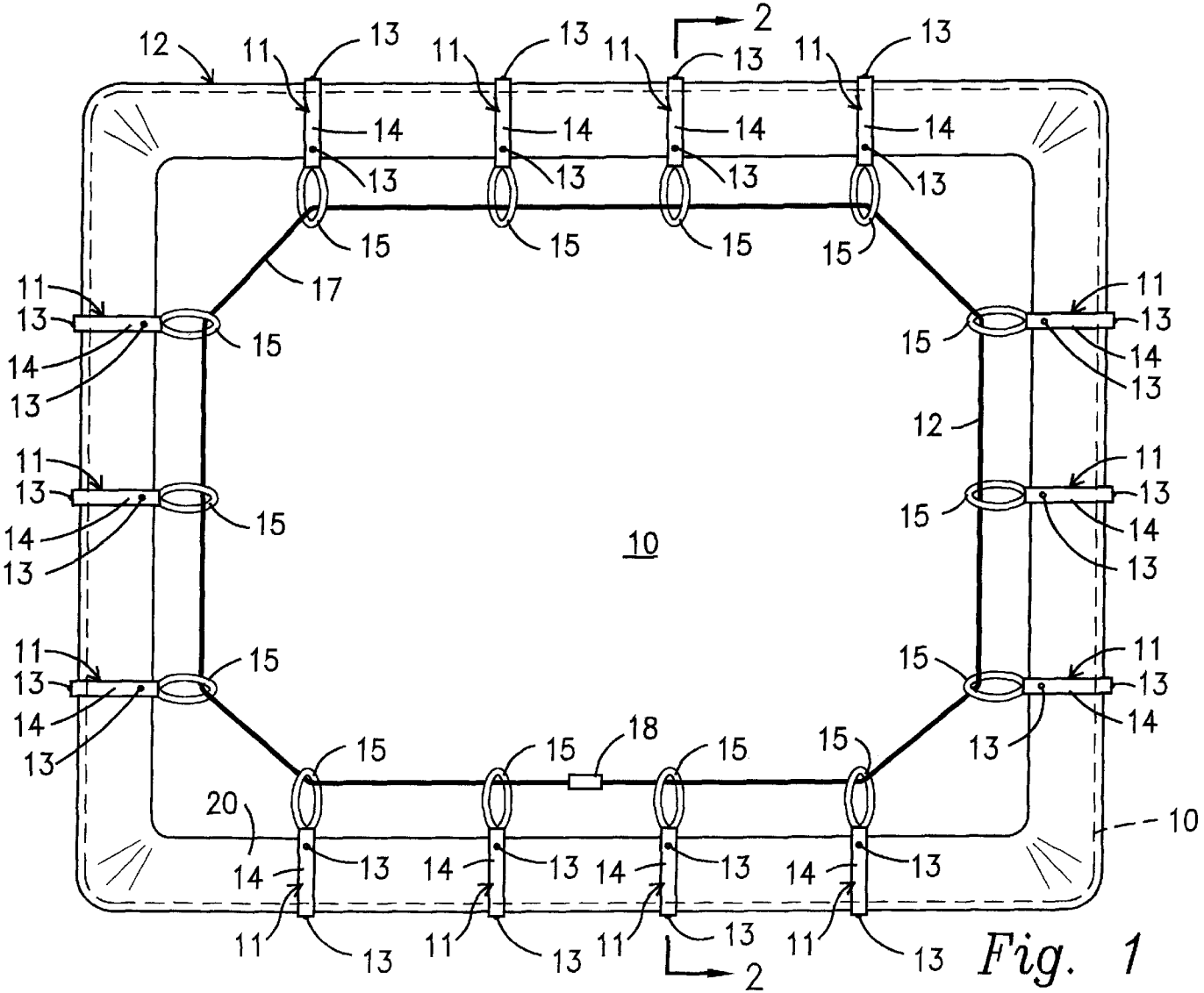
FIG. 1 is a side elevational view of a mattress standing on one of its long sides with a carrier placed thereon.

Referring to the drawings, a conventional mattress shown at 10 has a protective and supportive cover 12 thereon. The cover 12 has a peripheral portion 12B which completely covers the periphery of the mattress 10 and a flap portion 20 extending from the peripheral portion 12B and overlying about one foot of one side of the mattress around the entire periphery thereof and a flap portion 12A overlying about one foot of the other side of the mattress. A plurality of peripherally spaced straps 11 are each suitable secured to the cover 12 as by four rivets 13 spaced axially on the straps. More particularly the straps 11 overlying the peripheral portion 12B of the cover 12 are secured to the portion 12B by a pair of spaced rivets 13 and the straps extend from the peripheral portion to overly the full extent of the flap portions 12A and 20 and then terminates at its ends in an integral loop portion 15 and 15A respectively, which extends beyond the flap portion 20 and 12A. An elastic cord 17, such as a bungee cord, is threaded through all the loops 15, the cords ends are connected, in any one of a conventional manner, such as by tying at 18 such that the cord is stretched sufficient to tighten the cover 12 on the mattress 10. Likewise, a cord 17A is threaded through all the loops 15A. The portion of the straps 11 adjacent the radial inner end of each flap 20 and 12A is secured thereto by a rivet 13.

The portion of each strap 11 intermediate the rivets 13 thereon provides a hand hold location or handle 14 which may be grasped by the mover when moving or otherwise manipulating the mattress 10. Since there are a plurality of straps 11 secured to each of the four peripheral sides 12B of the mattress 10, maximum flexibility in moving the mattress is obtained when the mattress is carried with its plane vertical. Any one of the four peripheral sides can be the bottom, top, or either end of the mattress being manipulated, and can easily be rotated between such positions. The mattress can also be carried with the plane of the mattress disposed horizontally.

Figure 3:
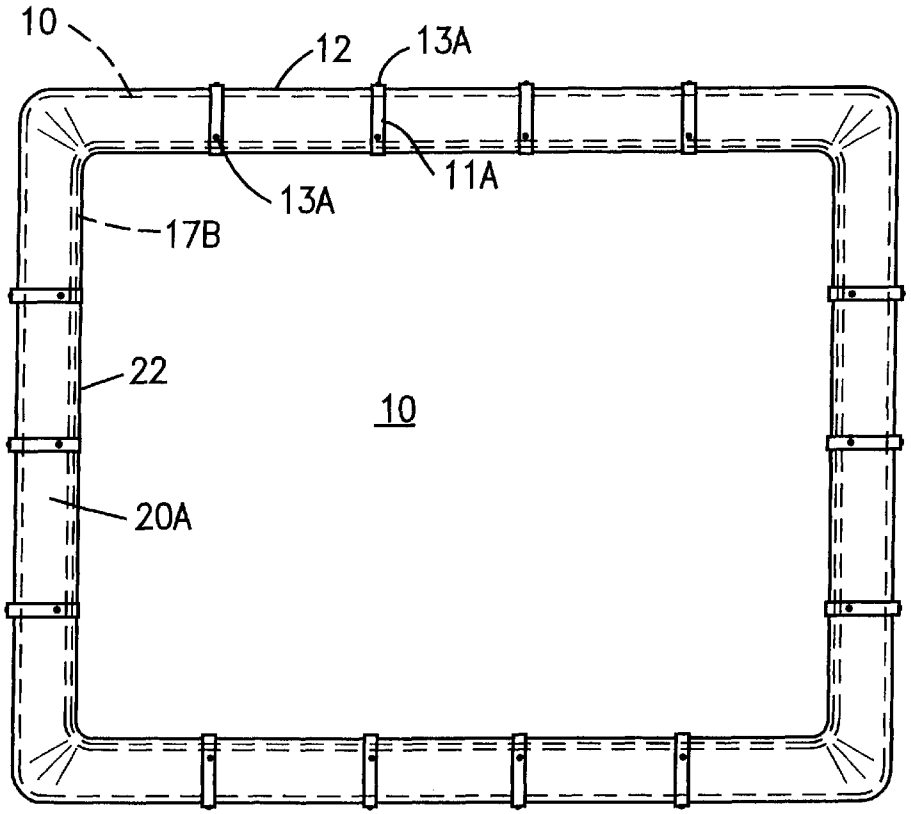
FIG. 3 is a view like FIG. 1 of a second embodiment of this invention, with the elastic cord contained in a hem of the carrier.
Figure 2:
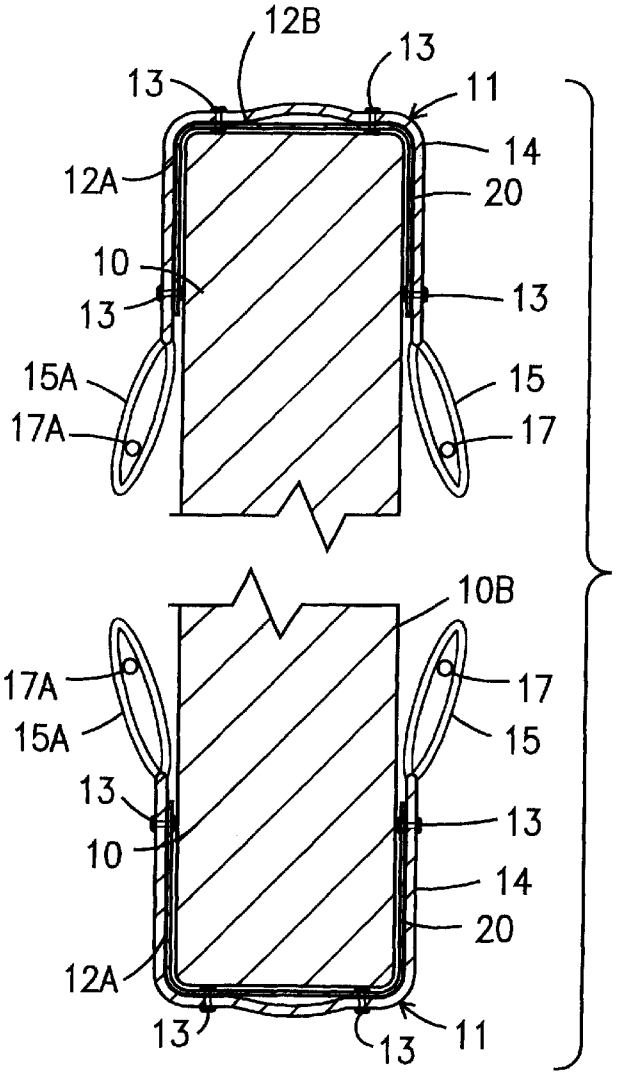
FIG. 2 is a sectional view, with central portions omitted, taken along the liens 2—2 in FIG. 1.

Referring now to FIG. 3, the elastic cord 17B is disposed in a peripheral hem 22 formed on the inner end of a flap 20A of the cover 12, with no loops 17 being utilized. As in the first embodiment, the cord 17A is secured tightly and the portions of the straps 11A between the rivets 13A serve as hand holds.

In both the above embodiment are shown four (4) straps on the long side of the mattress and three (3) straps on the short side thereof, it being understood that more or less straps can :be used depending on the size of the mattress with at least a pair of straps on each side.

While only preferred embodiments have been shown and described, it is readily apparent that many changes can be made therein without departing from the scope of this invention as defined in the following claims:

What is claimed is:

1. A cover for a mattress, which cover has graspable handles for grasping when moving the mattress, comprising in combination, a) a cover for the mattress, which cover has,
   1) a peripheral portion for overlying the periphery of the mattress,
   2) a flap portion integral with said peripheral portion for overlying a portion of one face of the mattress, and,
   3) another portion of said cover being formed integrally with said peripheral portion for overlying at least a portion of the other face of the mattress, b) graspable handle means secured to said cover which comprises a plurality of straps having a pair of opposed ends and securing means securing one end of said strap to said peripheral portion, and the other end thereof to said flap portion, and c) an elastic cord resiliently acting upon the inner end of said flap portion for resiliently holding said cover on the mattress, and said handle means have loop means formed thereon on the end of said flap portion for receiving said elastic cord, and said elastic cord passes through said loop means., and said handle means have loop means formed thereon on the end of said flap portion for receiving said elastic cord, and said elastic cord passes through said loop means.

2. A cover for a mattress, which cover has graspable handles for grasping when moving the mattress, comprising in combination, a) a cover for the mattress, which cover has, 1) a peripheral portion for overlying the periphery of the mattress, 2) a flap portion integral with said peripheral portion for overly ing a portion of one face of the mattress, and, 3) another portion of said cover being formed integrally with said peripheral portion for overlying at least a portion of the other face of the mattress, b) graspable handle means secured to said cover which comprises a plurality of straps having a pair of opposed ends and securing means securing one end of said strap to said peripheral portion, and the other end thereof to said flap portion, and c) an elastic cord resiliently acting upon the inner end of said flap portion for resiliently holding said cover on the mattress, d) said flap portion has a hem formed on the inner side thereof and said elastic cord passes through said hem.

3. A cover for a mattress, which cover has graspable handles for grasping when moving the mattress, comprising in combination, a) a cover for the mattress, which cover has, 1) a peripheral portion for overlying the periphery of the mattress, 2) a flap portion integral with said peripheral portion for overlying a one face of the mattress, and, 3) another portion of said cover being formed integrally with said peripheral portion for overlying at least a portion of the other face of the mattress, b) graspable handle means secured to said cover which comprises a plurality of straps having a pair of opposed ends and securing means securing one end of said strap to said peripheral portion, and the other end thereof to said flap portion, and c) an elastic cord resiliently acting upon the inner end of said flap portion for resiliently holding said cover on the mattress, and said handle means have loop means formed thereon on the end of said flap portion for receiving said elastic cord, said elastic cord passes through said loop means, d) said straps overlie said peripheral portion and are secured thereto by a first rivet and overlie said flap portion and are secured thereto by a second rivet and the portion of said straps between said rivets is a graspable portion.

4. A cover for a mattress, which cover has graspable handles for grasping when moving the mattress, comprising in combination, a) a cover for the mattress, which cover has, 1) a peripheral portion for overlying the periphery of the mattress, 2) a flap portion integral with said peripheral portion for overlying a portion of one face of the mattress, and, 3) an other portion of said cover being formed integrally with said peripheral portion for overlying at least a portion of the other face of the mattress, b) graspable handle means secured to said cover which comprises a plurality of straps having a pair of opposed ends and securing means securing one end of said strap to said peripheral portion, and the other end thereof to said flap portion, and c) an elastic cord resiliently acting upon the inner end of said flap portion for resiliently holding said cover on the mattress, d) said other portion of said cover is a second flap portion, said plurality of straps have a pair of opposed ends positioned to extend from said flap portion over said peripheral portion and onto said second flap portion, and said securing means secures said straps to both said flap portions and said peripheral portion.

* * * * *